US006571991B2

(12) United States Patent
Jourdin

(10) Patent No.: US 6,571,991 B2
(45) Date of Patent: Jun. 3, 2003

(54) FLUID DISPENSER

(75) Inventor: Gilles Jourdin, Combon (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/776,179

(22) Filed: Feb. 2, 2001

(65) Prior Publication Data

US 2002/0047026 A1 Apr. 25, 2002

(30) Foreign Application Priority Data

Oct. 23, 2000 (FR) ..... 00 13566

(51) Int. Cl.[7] ..... B67D 5/42
(52) U.S. Cl. ..... 222/321.9; 222/385
(58) Field of Search ..... 222/182, 321.7, 222/321.9, 383.1, 385

(56) References Cited

U.S. PATENT DOCUMENTS

| | | | | |
|---|---|---|---|---|
| 4,773,553 A | | 9/1988 | Brocklin | |
| 4,984,702 A | * | 1/1991 | Pierpont | 222/321.7 |
| 5,941,428 A | * | 8/1999 | Behar et al. | 222/321.7 |
| 6,186,369 B1 | * | 2/2001 | Rosenthal | 222/321.7 |
| 6,253,941 B1 | * | 7/2001 | VanBrocklin et al. | 222/321.9 |
| 6,273,303 B1 | * | 8/2001 | de Pous et al. | 222/321.7 |

FOREIGN PATENT DOCUMENTS

FR 97 07317 A1 12/1998

OTHER PUBLICATIONS

Rapport De Recherche Préliminaire for FR 0013566 (2 pages).

U.S. patent application Ser. No. 09/445,666, filed Dec. 9, 1999.

* cited by examiner

*Primary Examiner*—Kenneth Bomberg
(74) *Attorney, Agent, or Firm*—Wood, Phillips, Katz, Clark & Mortimer

(57) ABSTRACT

A fluid dispenser comprises a container (1) defining a reservoir having a neck (10) defining an opening (15) putting the inside of the reservoir in communication with the outside, a dispenser member (2) mounted in the neck (10) of the container (1) so as to extract fluid from the reservoir, and a fixing structure for fixing the dispenser member to the neck of the container. The fixing structure comprises recess-forming structure (33) for receiving the dispenser member and fastening structure (36, 6, 48) for fastening to the neck of the container. The fixing structure further comprises a substantially cylindrical sheath (30, 50) that extends around the neck. The fixing structure further comprises a ring (4) disposed around the neck of the container, and an annular element (36, 6, 48) in contact with the outside wall (13) of the neck (10). The ring (4) is engaged in a sheath (30, 50) so as to urge the annular element (36, 6, 48) against the outside wall of the neck.

13 Claims, 4 Drawing Sheets

FLUID DISPENSER

The present invention relates to a fluid dispenser comprising a container, a dispenser member such as a pump or a valve, and fixing means for fixing the dispenser member to the container. In general, the container defines a reservoir serving to contain a fluid to be dispensed by the dispenser member. The container is provided with a neck defining an opening in which the dispenser member is fixed by the fixing means which, in general, comprise recess-forming means for receiving the dispenser member, often by snap-fastening. The fixing means further comprise fastening means for fastening to the neck of the container.

Conventionally, the fixing means often comprise a fixing piece defining a substantially cylindrical skirt that extends around the neck. Also conventionally, the neck is provided with a reinforcing rim that forms an inwardly-extending ledge that meets a finer bottom portion of the neck that is connected to the reservoir via a shoulder.

A well known fixing technique is to use the skirt to achieve fastening under the reinforcing rim, i.e. at the ledge. Several technical solutions of that type are known. In particular, the skirt can be provided with tabs terminated by snap-fastening heads serving to come into engagement under the reinforcing rim against the ledge. In general, to lock the tabs in position, a band is used that covers the skirt. Another technique makes provision to form the skirt in continuous manner and to provide the inside of the skirt with a snap-fastening bead that is received under the reinforcing rim.

In the fixing technique using snap-fastening tabs and snap-fastening heads, it is necessary to use a locking band. Therefore, it is not possible to mount the band before the skirt is mounted on a container neck. In the other technique in which snap-fastening is achieved by means of a continuous skirt providing with a bead on its inside, the fixing is sometimes not secure, and it is then possible to withdraw the dispenser member manually by pulling it. Tamper-proofing is thus not guaranteed before the user uses the dispenser for the first time.

An object of the invention is to remedy the above-mentioned drawbacks of the prior art by defining a dispenser in which the fixing means are properly secure while omitting a locking band. Therefore, if a band is used, it is merely a decorative trim band which can be mounted previously onto the skirt even before the skirt is mounted on the neck of the container.

To this end, the present invention makes provision for the fixing means to comprise a ring disposed around the neck of the container, and an annular element in contact with the outside wall of the neck, the ring being engaged in a sheath formed by the skirt or the band so as to urge the annular element against the outside wall of the neck. Thus, use is made of the relative displacement of the ring to urge, or even to press, the annular element against the outside wall of the neck. When the annular element is pressed strongly by being wedged by the ring, the annular element may serve as a sealing element in the same way as a neck gasket. It is the engagement of the ring in the sheath that makes it possible for these two parts to move relative to each other so as to bring the annular element into contact with the outside wall of the neck.

The annular element may be part of the skirt or part of the ring in the form of a deformable portion urged by the ring or the skirt into contact with the outside wall of the neck. When the skirt forms the deformable portion, it is the ring that serves as cam to urge said deformable portion against the outside wall of the neck, and when it is the ring that forms the deformable portion, it is the skirt that urges the ring against the outside wall of the neck. The urging of the skirt or of the ring may be achieved by means of a cam system.

In a variant, the annular element may be a separate deformable piece, e.g. in the form of an O-ring seal disposed between the skirt, the ring, and the outside wall of the neck.

The engagement of the ring inside the skirt or inside the band can be achieved by various techniques, in particular by means of screwing, clamping, snap-fastening, or barbs. By using barbs, the engagement is irreversible so that the fixing is permanent.

In an embodiment, the neck is provided with locking means for preventing the ring from rotating about the neck. It is necessary to prevent the ring from rotating in particular when the engagement between the ring and the skirt is achieved by screwing. It is necessary to lock the ring on the neck in order to screw the skirt onto the ring without the ring rotating with the skirt.

When the engagement between the ring and the skirt is achieved by means of barbs, it is necessary to prevent the ring from moving in translation on the neck, in order to fit the skirt over the ring. To this end, the ring may bear via its bottom end against the container. More precisely, the ring bears against the container where the neck meets the body of the reservoir.

According to another characteristic, the skirt may be provided with trim in contact with the skirt at the ring. Since the outside wall of the skirt is not deformed when the ring is moved, it is possible to mount the trim band on the skirt even before it is mounted on the neck of a container.

The invention is described more fully below with reference to the accompanying drawings which give embodiments of the invention by way of non-limiting example.

In the drawings:

FIG. 1*a* is a vertical cross-section view through a fluid dispenser in a first embodiment of the invention;

FIG. 1*b* is an enlarged view of that portion of the FIG. 1*a* dispenser which shows how the fixing to the neck is achieved;

Figure 1A:
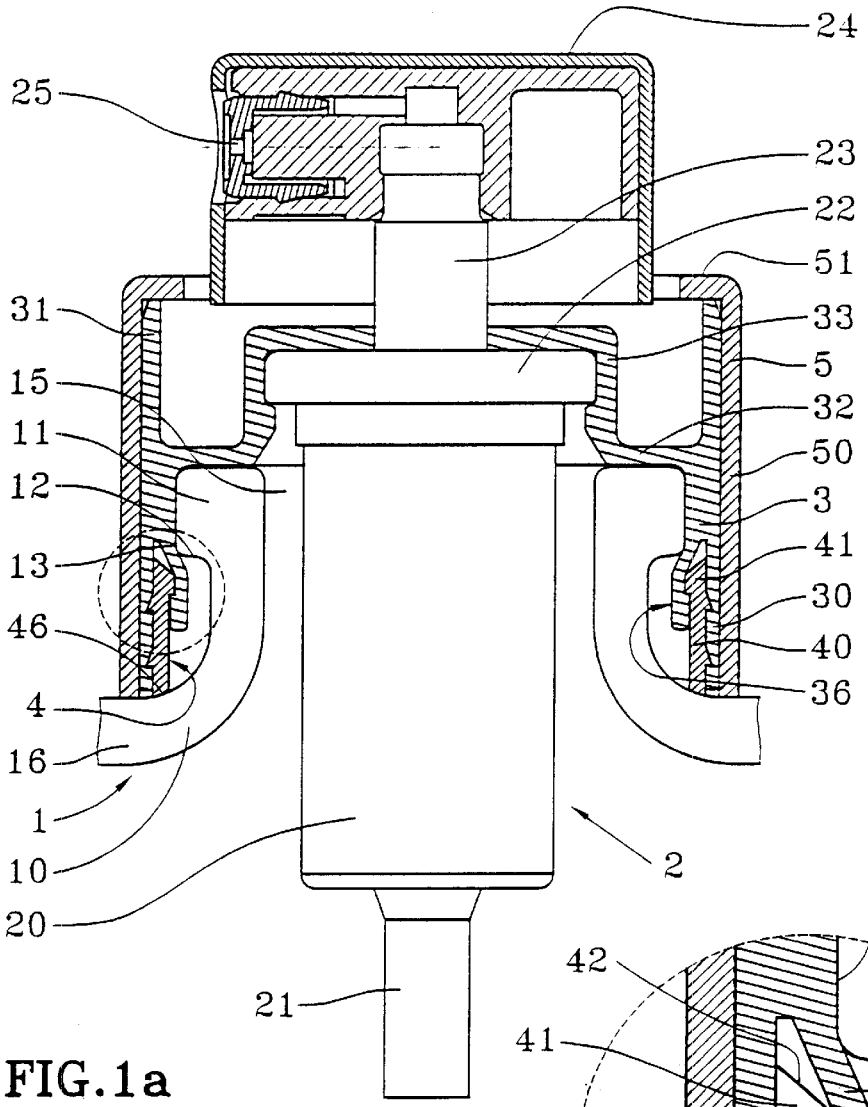

In all of the embodiments shown in the figures, the fluid dispenser is shown only in part, since the reservoir is not shown. The figures show the top portion of the container only, which portion forms a neck 10 that forms an opening 15 in which a dispenser member extends, the dispenser member being a pump 2 in these examples. The dispenser member may equally well be a valve. The neck 10 of the container 1 defines an outside peripheral wall 13. The pump 2 is fixed in the opening 15 in the neck 10 by fixing means 3. The fixing means comprise a fixing piece 3 defining a recess 33 in which a collar 22 formed by the body 20 of the pump 2 is received by snap-fastening. The snap-fastening recess 33 is provided with a central opening through which the actuator rod 23 of the pump 2 extends. A pusher 24 optionally provided with a nozzle 25 is mounted on the actuator rod 23. The other end of the body of the pump 20 is provided with an inlet sleeve 21 on which it is optionally possible to fit a dip tube that extends to the bottom of the reservoir in the container 1. The snap-fastening recess 33 then extends outwards to define an annular web 32 that comes into abutment on the top end of the neck 10. The fixing piece 3 is extended downwards around the outside periphery of the radial web 32 by a skirt 30 that surrounds the neck 10. For reasons of esthetic appearance, the skirt 30 may extend downwards almost into contact with the container 1.

Thus far, this is a design that is quite conventional for a fluid dispenser.

In all of the embodiments, the neck 10 of the container 1 is provided with a reinforcing rim 11 that projects outwards. This reinforcing rim 11 has a ledge extending back inwards to the thinner bottom portion of the neck 10 that connects to the reservoir of the container by forming a shoulder 16. The outside periphery 13 of the neck 10 is formed by the outside surface of the reinforcing rim 11 and of the ledge 12.

In the invention, in addition to the fixing piece 3, the fixing means further comprise a ring 4 which also extends around the neck 10, inside the skirt 30. The ring engages with the inside of the skirt 30 either by screwing or by means of barbs.

In the invention, in addition to the fixing piece 3 and to the ring 4, the fixing means further comprise an annular element that is in contact with the outside peripheral wall 13 of the neck 10. In other words, the annular element is in contact either with the reinforcing rim 11 or with the ledge 12.

In the invention, the ring 4 as engaged in the skirt 30 urges the annular element into contact against the outside wall of the neck 10. This is basic principle of the present invention.

Figure 1B:
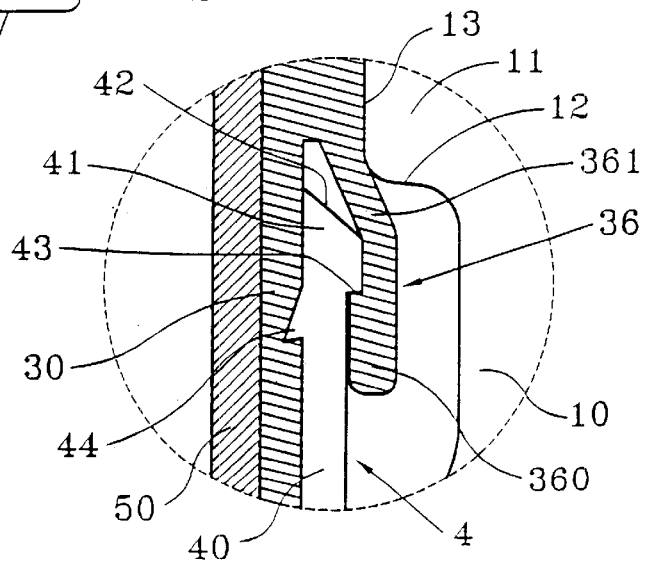

Reference is made below more particularly to FIGS. 1*a* and 1*b* to explain the first embodiment of the invention. In this embodiment, the ring 4 engages in the skirt 30 by means of barbs. As shown more clearly in FIG. 1*b*, the ring 4 is formed with a body 40 underlying a head 41.

Barb-forming projections 44 are provided on the outside wall of the body 40 of the ring 4 to come to bite into the inside wall of the skirt 30. The barb-forming projections 44 are oriented such that the ring 4 can be displaced in the skirt in one direction only, namely upwards. It is impossible to cause the ring 4 to move back down inside the skirt 30.

The annular element is formed in this example by a deformable portion 36 defined by the skirt 30. The deformable portion 36 extends the whole way around the skirt 10, or in one or more segments around said skirt, or else in the form of tabs therearound. The deformable portion 36 comprises a body 361 which is terminated by a head 360. In the initial state (not shown), the ring 4 is engaged in the skirt 30 in part only so that the deformable portion 36 can extend along the skirt 30 in alignment with the ring 4. The head 41 of the ring 4 then lies just beneath the head 360 of the deformable portion 36. In this configuration, it is then possible to engage the fixing means 3 onto the neck 10 of the container 1 without difficulty, since the deformable portion 36 is not projecting inwards. As soon as the bottom end 46 of the ring 4 comes into contact with the container 1, additional pressure on the fixing means 3 causes the ring 4 to move in the skirt 30 by rising inside it. The head 41 of the ring 4 is provided with a sloping cam surface 42 which makes it possible for the head 41 to engage under the head 360 of the deformable portion 36. The head 41 being engaged between the head 360 and the skirt 30 causes the head 360 to move inwards, i.e. under the reinforcing rim 11 and under the ledge 12. By continuing to press on the fixing means 3, it is possible to cause the ring 4 to continue to engage inside the skirt 30 until its head 41 snap-fastens onto the head 360 of the deformable portion 36 at a mutual catch 43. The ring 4 is then engaged to the maximum extent inside the skirt 30, which is shown in FIG. 1*a* and in an enlarged view in FIG. 1*b*. In this position, the head 360 is urged inwards, as is a portion of the body 361 that is disposed to be sloping so that its outside wall comes into bearing contact against the ledge 12 where said ledge meets the reinforcing rim 11. When the deformable portion 36 is formed continuously around the entire neck, the contact between the deformable portion 36 and the inside edge of the reinforcing rim 11 takes place continuously over the entire periphery of the neck, thereby simultaneously achieving secure fixing and effective sealing. It should be noted that, in this embodiment (continuous deformable portion), it is possible to omit a neck gasket interposed between the flange 32 and the top end of the neck 10.

It should be noted that, in this embodiment, it is possible to omit barb profiles 44 because the head 41 is snap-fastened on the head 360. As a result of this alone, it is impossible to displace the ring 4 in the opposite direction in order to extract it from the skirt 30. The barb-forming projections are then merely additional means for improving the fastening of the ring 4 inside the skirt 30.

It should also be noted that the fixing means 3 are covered with a trim band 5 which is in the form of a cylindrical body 50 that is terminated at its top end by an inwardly-extending folded-down edge 51 that comes into abutment against the end of the socket 31. The cylindrical body 50 of the trim band 5 is in contact with the skirt 30 at the ring 4. It can be observed that the ring 4 moving inside the skirt 30 does not give rise to any outward radial deformation of the skirt 30, which it does in the prior art fixing techniques described above. It is thus possible to mount the trim 5 on the fixing means 3 prior to mounting the fixing means on the neck of a container. It is thus possible to deliver a unit made up of the ring and of the fixing means covered with the trim 5 in the assembled state. All that then remains to be done is to fill the container and to mount the fixing means together with the pump and with the trim 5 as a single unit.

Figure 2:
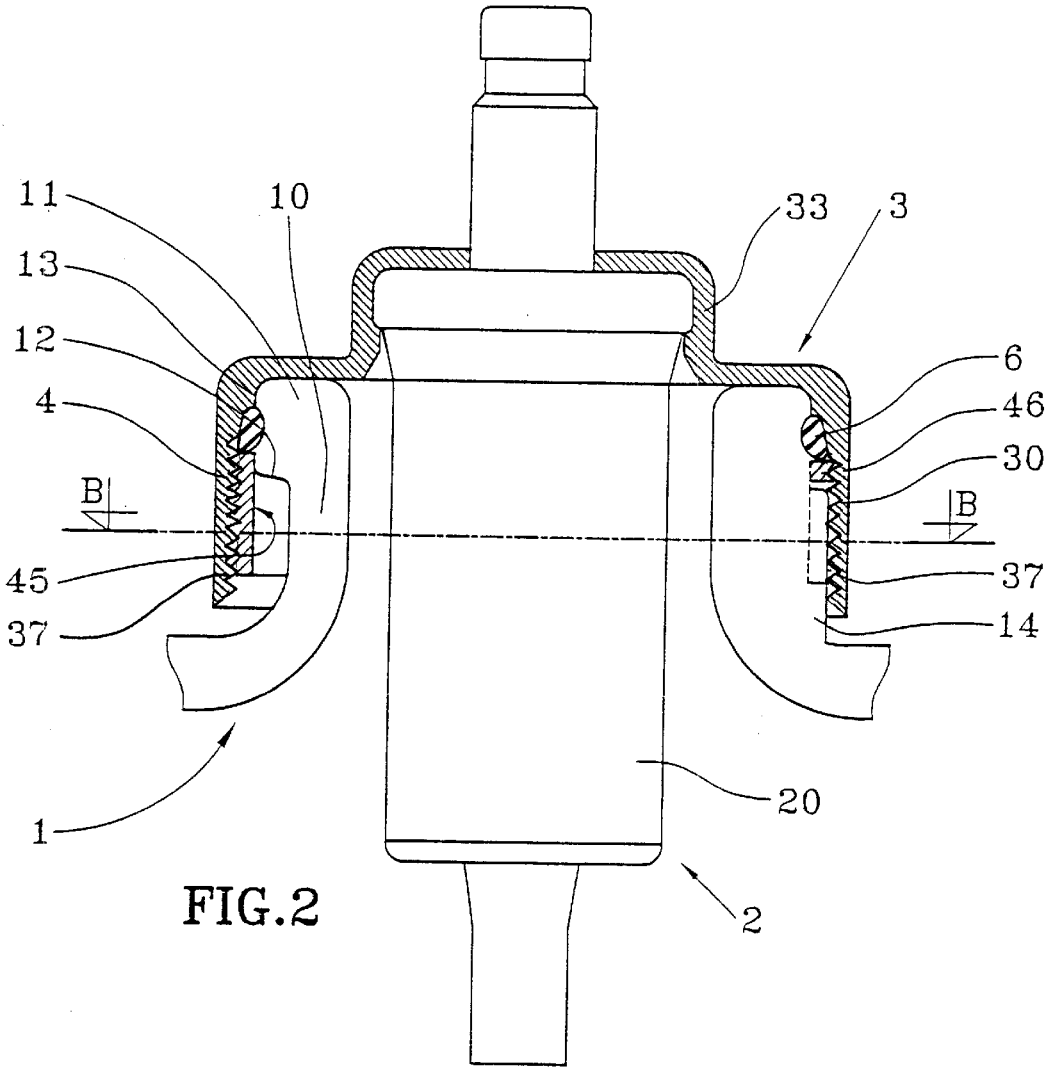
FIG. 2 is a vertical cross-section view through a fluid dispenser in a second embodiment of the invention.
Figure 3:
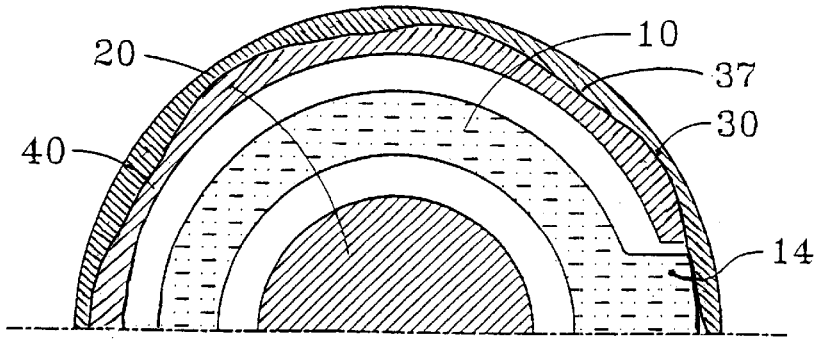
FIG. 3 is a horizontal section view on line BB of FIG. 2.

Reference is made below to FIGS. 2 and 3 in order to describe a second embodiment of the invention. In this embodiment, the fixing means 3 also form a snap-fastening recess 33 for receiving the body 20 of the pump 2, and a skirt 30 that extends around the outside of the neck 10 which is provided with a reinforcing rim 11 and with an inwardly-extending ledge 12. In this embodiment as well, the fixing means comprise a ring 4 that engages the inside of the skirt 30, and an annular element 6 interposed between the ring 4 and the skirt 30.

In this embodiment, the engagement between the ring 4 and the skirt 30 is a threaded engagement so that the ring 4 screws into the skirt 30. The annular element 6 is in the form of a separate deformable piece disposed between the ring 4, the skirt 30 and the outside wall 13 of the neck 10. More precisely, the annular element 6, which acts as a fixing and sealing gasket in this example, is compressed between the top end of the ring 4 and the skirt 30 so as to be urged under stress against the outside wall 13 of the neck 10 where it forms a sealing gasket. The annular element 6 is received in a recess formed in part by the skirt 30 and into which the top end of the ring 4 penetrates in order to reduce the volume of the recess, and thus to compress the annular element which is inserted into said recess. It is easy to understand that screwing the ring 4 into the skirt 30 results in the annular element 6 being compressed and thus urged strongly against the outside wall 13 of the neck 10.

In the initial state, it suffices for the ring 4 not to urge the annular element 6 so that it is possible to engage the fixing means 3 onto the neck of a container with no difficulty. Then, it suffices for the skirt 30 to be screwed onto the ring 4 to cause the ring 4 to rise inside the skirt 30, thereby compressing the annular element 6. For this purpose, it is necessary to prevent the ring 4 from rotating on the neck 10. To this end, the neck 10 forms locking means in the form of two ribs 14 which extend under the reinforcing rim 11 of the neck and projecting even further outwards. The ring 4 is provided with two deep notches in which the two ribs 14 are engaged. The notches in the ring 4 extend deeply so that only a shallow continuous collar 46 remains that is positioned above the ribs 14 as shown in FIG. 2. In this way, the ring 4 is prevented from rotating about the neck 10. The skirt 30 can then be screwed onto the ring without any risk of the ring rotating with the skirt.

In this embodiment, instead of the ring bearing via its bottom end against the container, the ring is prevented from rotating by means of the reinforcing ribs 14.

It should be noted that, in this embodiment, the sealed fixing to the neck is achieved at the cylindrical outside wall of the neck, rather than at its shoulder 12, so that the neck may be formed without a rim 11.

Figure 4:
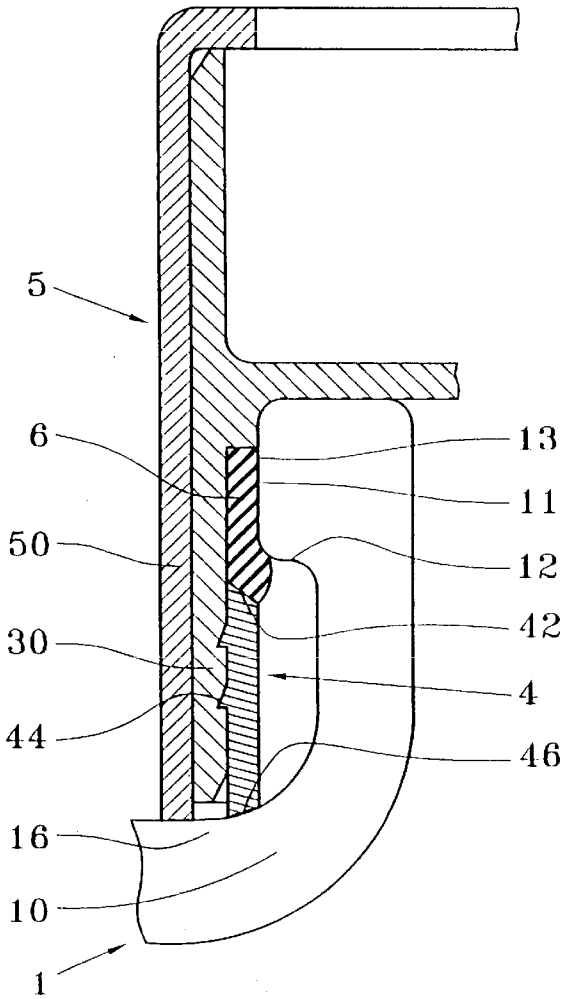
FIG. 4 is a fragmentary section in vertical cross-section through a fluid dispenser in a third embodiment of the invention.

Reference is made below to FIG. 4 to explain another embodiment. In this embodiment, which is substantially similar to the embodiment shown in FIG. 2, the annular element 6 is in the form a separate deformable piece 6 interposed between the ring 4, the skirt 30, and the outside wall 13 of the neck 10. In this example, the annular element 6 is in the form of a cylindrical gasket received in a recess formed by the skirt 30 and open facing downwards so that the ring 4 can penetrate into the recess so as to urge the element 6 into sealed pressed contact against the outside surface 13 of the neck 10. It can be seen that the annular element 6 co-operates not only with the cylindrical wall of the reinforcing rim 11 but also with the ledge 12 so that the annular element 6 extends radially inwards below the reinforcing rim 11.

In this embodiment, the ring 4 is not screwed inside the skirt 30 as it is in the embodiment shown in FIGS. 2 and 3, but rather the ring 4 is engaged via barbs inside the skirt 30. To this end, the outside wall of the ring 4 is provided with barb-forming projections 44 suitable for biting into the inside wall of the skirt 30. The top end of the ring 4 is provided with a cam surface 42 which slopes inwards so as to urge the annular element 6 under the reinforcing rim 11 at the ledge 12.

In this example as well, the ring 4 is caused to move inside the skirt 30 by means of the bottom end 46 of the ring 4 bearing against the container 1. The ring 4 thus moves in the skirt 30 in the same way as in FIGS. 1*a* and 1*b*.

Figure 5:
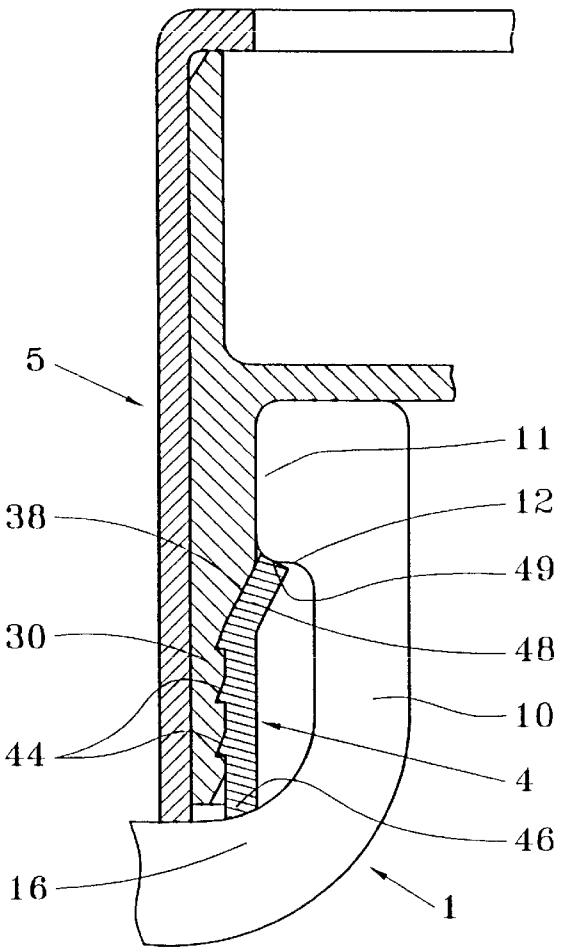
FIG. 5 is a view similar to the view of FIG. 4 for a fourth embodiment of the invention.

FIG. 5 shows a fourth embodiment in which the ring 4 forms the annular element designated in this example by the numerical reference 48. The ring 4 is provided with a deformable top portion 48 whose top end 49 comes into engagement under the reinforcing rim at the ledge 12. In order to urge the portion 48 of the ring 4 to deform under the reinforcing rim 11, the skirt 30 is provided with a cam surface 38 along which the top end 48 of the ring 4 is deformed as the ring 4 rises inside the skirt 30 by means of its bottom end 46 bearing against the shoulder of the container 1. In this example, it is essential for the ring 4 to be dimensioned accurately so that its top end 49 can come into contact under the ledge 12 while its bottom end 46 is in contact with the shoulder of the container.

In this embodiment, the engagement between the ring 4 and the skirt 30 is also an irreversible engagement achieved by means of barbs.

Figure 6:
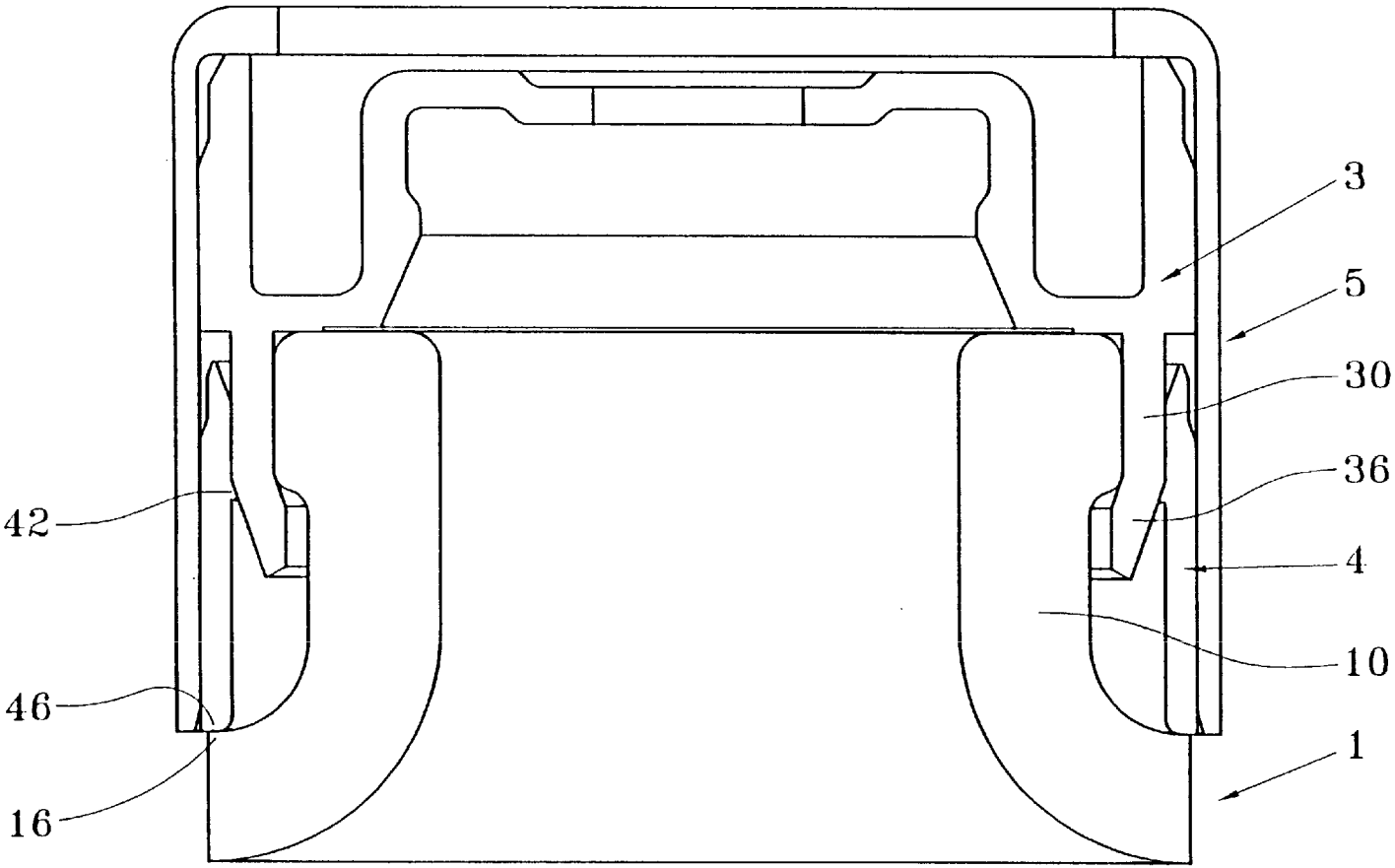
FIG. 6 is a view similar to the views of FIGS. 4 and 5 for a fifth embodiment of the invention.

A fifth embodiment shown in FIG. 6 differs from the preceding embodiments in that the ring 4 engages in the trim band 5 by being radially clamped therein. The ring is received between the band and the skirt. The ring is provided with a cam 42 suitable for causing a portion 36 of skirt to deform inwards under the reinforcing rim into abutment against the ledge. The ring also bears via its bottom end against the shoulder of the container to cause said ring to move inside the band.

It should be noted that the mode of engagement (screw-fastening or by means of barbs) between the ring and the skirt 30 may be interchanged in each of the embodiments described.

The principle of the invention is to cause a ring to move inside the skirt or inside the band so as urge an element against the outside wall of the neck. The ring may be moved by it bearing against the shoulder of the container, or by it being prevented from rotating on the neck of the container. The element that comes into contact with the outside wall of the neck may also be a portion of skirt, a portion of the ring, or an additional part.

What is claimed is:

1. A fluid dispenser comprising:

a container (1) defining a reservoir serving to contain a fluid, said container being provided with a shoulder (16), and a neck (10) extending from said shoulder and defining an opening (15) putting the inside of the reservoir in communication with the outside, said neck having a peripheral outside wall (13);

a dispenser member (2) mounted in the neck (10) of the container (1) so as to extract fluid from the reservoir; and fixing means (3, 4, 5, 6) for fixing the dispenser member to the neck of the container, said fixing means comprising recess-forming means (33) for receiving the dispenser member and fastening means (36, 6, 48) for fastening to the neck of the container, said fixing means further comprising a substantially cylindrical sheath (30, 50) that extends around the neck;

the fixing means further comprising (A) a ring (4) that is disposed around the neck of the container, and that defines a bottom end (46), and (B) an annular element (36, 6, 48) in contact with the peripheral outside wall (13) of the neck, the ring (4) being engaged in the sheath (30, 50) so as to urge the annular element (36, 6, 48) against the peripheral outside wall (13) of the neck (10), the ring (4) bearing via its bottom end (46) against the shoulder (16) of the container (1).

2. A fluid dispenser according to claim 1, in which the fixing means comprise a fixing piece (3) defining a skirt (30) and a trim band (5) extending around the skirt (30), the band forming the sheath in which the ring (4) is engaged.

3. A fluid dispenser according to claim 1, in which the annular element is formed by a deformable portion (48) of the ring (4).

4. A fluid dispenser according to claim 1 in which the engagement between the ring (4) and the sheath (30, 50) is by means of barbs.

5. A fluid dispenser according to claim 1, in which the engagement between the ring (4) and the sheath (30, 50) is by means of a tight fit.

6. A fluid dispenser according to claim 1, in which the outside wall (13) of the neck forms an inwardly-extending ledge (12), the annular element (36, 6, 48) being pressed against said ledge (12).

7. A fluid dispenser according to claim 1, in which the ring (4) forms a cam (42) for urging the annular element (36) against the outside wall (13) of the neck.

8. A fluid dispenser according to claim 1, in which the annular element is a sealing element providing peripheral sealing at the neck of the container.

9. A fluid dispenser according to claim 1, in which the fixing means comprise a fixing piece (3) defining the recess-forming means (33) and a skirt (30) extending around the outside wall (13) of the neck, the skirt (30) forming the sheath in which the ring (4) is engaged.

10. A fluid dispenser according to claim 9, in which the annular element is a separate deformable piece (6) disposed between the skirt (30), the ring (4) and the outside wall (13) of the neck.

11. A fluid dispenser according to claim 9, in which the annular element is formed by a deformable portion (36) of the skirt (30).

12. A fluid dispenser according to claim 9, in which the skirt (30) forms a cam (38) for urging the annular element (48) against the outside wall (13) of the neck.

13. A fluid dispenser according to claim 2, in which the skirt (30) is provided with trim (5) in contact with the skirt at the ring.

* * * * *